United States Patent [19]

Yamagishi et al.

[11] Patent Number: 4,465,360

[45] Date of Patent: Aug. 14, 1984

[54] ELECTROPHOTOGRAPHIC COPYING MACHINE

[75] Inventors: Toshio Yamagishi; Hiroaki Uchiyama; Ikuo Itoh; Yoshiaki Imanaka, all of Nara, Japan

[73] Assignee: Sharp Kabushiki Kaisha, Osaka, Japan

[21] Appl. No.: 360,811

[22] Filed: Mar. 22, 1982

[30] Foreign Application Priority Data

Mar. 31, 1981 [JP] Japan ..... 56-48692
Mar. 31, 1981 [JP] Japan ..... 56-48693

[51] Int. Cl.[3] ..... G03G 15/00

[52] U.S. Cl. ..... 355/14 R; 355/14 D; 355/14 SH; 355/15

[58] Field of Search ..... 355/14 R, 14 CH, 14 E, 355/14 C, 14 SH, 14 D, 15, 16, 8, 3 R

[56] References Cited

U.S. PATENT DOCUMENTS

| | | | |
|---|---|---|---|
| 3,637,306 | 1/1972 | Cooper | 118/652 Y |
| 3,647,293 | 3/1972 | Queener | 355/16 Y |
| 3,976,375 | 8/1976 | Kurita et al. | 355/16 Y |
| 4,140,386 | 2/1979 | Satomi | 355/14 R |
| 4,142,165 | 2/1979 | Miyakawa et al. | 355/15 X |
| 4,183,655 | 1/1980 | Umahashi et al. | 355/15 X |
| 4,185,910 | 1/1980 | Nomural et al. | 355/15 |
| 4,264,186 | 4/1981 | Fujiwara | 355/14 R |
| 4,361,922 | 12/1982 | Karal | 355/15 X |

FOREIGN PATENT DOCUMENTS

| | | | |
|---|---|---|---|
| 27425 | 3/1978 | Japan | 355/14 SH |
| 7841 | 1/1981 | Japan | 271/171 |

OTHER PUBLICATIONS

*IBM Technical Disclosure Bulletin,* vol. 18, No. 7, Dec. 1975, Colglazier et al., "Paper Size Indicator."

*Primary Examiner*—J. V. Truhe
*Assistant Examiner*—J. Pendegrass
*Attorney, Agent, or Firm*—Birch, Stewart, Kolasch & Birch

[57] ABSTRACT

An electrophotographic copying machine includes a combined developing-cleaning magnetic brush element. When the copy sheet is smaller than half the size of a photosensitive drum surface, two sheets of copy are obtained by three revolutions of the photosensitive drum in a multi-copy mode. During the first revolution of the photosensitive drum, the combined developing-cleaning magnetic brush element conducts the developing operation onto a first half section of the photosensitive drum and conducts the cleaning operation onto a second half section of the photosensitive drum. During the second revolution of the photosensitive drum, the first half section is cleaned and the second half section is developed. During the third revolution of the photosensitive drum, the first and second half sections are cleaned by the combined developing-cleaning magnetic brush element.

7 Claims, 6 Drawing Figures

ELECTROPHOTOGRAPHIC COPYING MACHINE

BACKGROUND AND SUMMARY OF THE INVENTION

The present invention relates to an electrophotographic copying machine and, more particularly, to a copying process in an electrophotographic copying machine which includes a combined developing-cleaning magnetic brush unit.

An electrophotographic copying machine has been proposed, which has a combined developing-cleaning unit for selectively performing a developing operation and a cleaning operation. A typical system of the above-mentioned electrophotographic copying machine is described in U.S. Pat. No. 3,647,293 entitled "COPYING SYSTEM FEATURING COMBINED DEVELOPING-CLEANING STATION ALTERNATELY ACTIVATED" issued on Mar. 7, 1972. In this system, a magnetic brush element performs the developing operation at the first round of the photosensitive drum. At the second round of the photosensitive drum, a suitable bias voltage is applied to the magnetic brush element for cleaning the drum surface. The combined developing-cleaning magnetic brush element is effective to minimize the size of the electrophotographic copying machine. However, the copying speed is inevitably reduced because the photosensitive drum must rotate twice to complete one sheet copying operation.

Accordingly, an object of the present invention is to provide an improved copying process for an electrophotographic copying machine having a combined developing-cleaning magnetic brush element.

Another object of the present invention is to speed up the copying operation in an electrophotographic copying machine having a combined developing-cleaning magnetic brush element.

Still another object of the present invention is to provide a copying process in an electrophotographic copying machine, which ensures a uniform characteristic of a photosensitive drum surface.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a combined developing-cleaning magnetic brush element is disposed in an electrophotographic copying machine. A copy paper size detection element is provided for detecting a copy paper size and developing a first detection signal when, for example, the copy paper is greater than $A_4$. If the copy paper is smaller than or equal to $A_4$, the copy paper size detection element develops a second detection signal.

When the first detection signal is developed, the copying operation is conducted in the same manner as the conventional copying machine. That is, the photosensitive drum is rotated twice to complete one sheet of copying operation. When the second detection signal is developed, the copying machine of the present invention functions to divide the photosensitive drum surface into two regions. While the photosensitive drum rotates through the first revolution, the combined developing-cleaning magnetic brush element functions to develop a first region and to clean a second region. During the second revolution of the photosensitive drum, the first region is cleaned by the combined developing-cleaning magnetic brush element, and the second region is developed by the combined developing-cleaning magnetic brush element. That is, by dividing the photosensitive drum surface into two regions, the copying speed is enhanced when the copying machine is placed in the multi-copy mode and the copy paper is smaller than a half size of the surface of the photosensitive drum.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
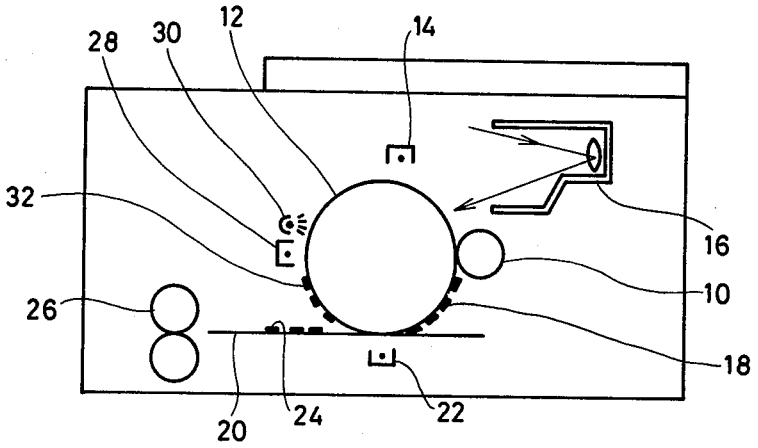
FIG. 1 PRIOR ART
FIG. 1 is a schematic sectional view of a copying machine of the prior art.

FIG. 1 schematically shows a copying machine of the prior art which includes a combined developing-cleaning unit. A combined developing-cleaning magnetic brush element 10 is disposed around a photosensitive drum 12 for selectively developing a latent image formed on the photosensitive drum 12 or cleaning the surface of the photosensitive drum 12. When a print button (not shown) is actuated, the photosensitive drum 12 is rotated in a first revolution to perform an initial cleaning operation and, then, the copying machine is placed in an actual operation mode. A corona charging unit 14 is activated to uniformly charge the surface of the photosensitive drum 12. An exposure system 16 functions to form an electrostatic latent image on the photosensitive drum 12. During this actual first round of the photosensitive drum 12, the combined developing-cleaning magnetic brush element 10 functions to develop the electrostatic latent image formed on the photosensitive drum 12. That is, the combined developing-cleaning magnetic brush element 10 operates as a developing brush.

The thus developed image 18 carried on the photosensitive drum 12 is transcribed onto a copy paper 20 by means of a transcription unit 22. The thus transcribed image 24 is fixed onto the copy paper 20 as the copy paper 20 passes through a fixing unit 26. On the other hand, an erase corona unit 28 and an erase lamp 30 are activated in order to erase the residual image carried on the photosensitive drum 12.

Then, the photosensitive drum 12 enters into an actual second revolution. The corona charging unit 14, the exposure system 16 and the transcription unit 22 are not activated. During the actual second revolution, the combined developing-cleaning magnetic brush element 10 functions to remove any residual toner 32 carried on the photosensitive drum 12. That is, the combined developing-cleaning magnetic brush element 10 operates as a cleaning device. If the copying machine is placed in the multi-copy mode wherein a plurality of copies are formed from the same original, the above mentioned operation is repeated to alternately conduct the developing operation and the cleaning operation.

The selective operation of the combined developing-cleaning magnetic brush element 10 is controlled by varying a bias voltage applied to the combined developing-cleaning magnetic brush element 10. A typical control is described in U.S. Pat. No. 3,647,293 entitled COPYING SYSTEM FEATURING COMBINED DEVELOPING-CLEANING STATION ALTERNATELY ACTIVATED" issued on Mar. 7, 1972. However, the bias voltage variation is not necessarily required because the combined developing-cleaning magnetic brush element 10 operates either as the developing unit or as the cleaning unit depending on the surface voltage level on the photosensitive drum 12.

Figure 2:
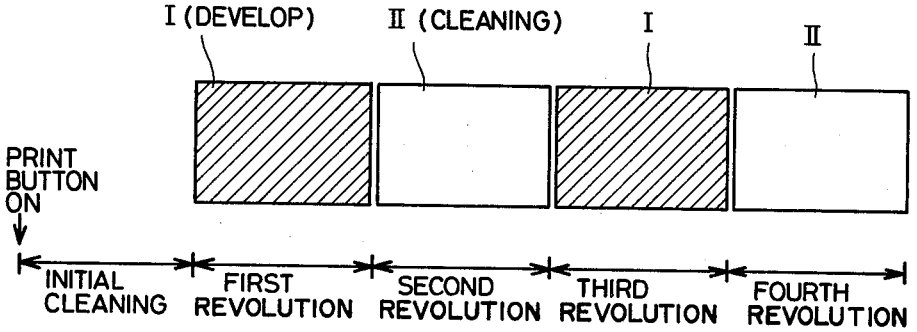
FIG. 2 PRIOR ART
FIG. 2 is a spread view of a photosensitive drum for explaining the copying operation of the copying machine of FIG. 1, wherein one sheet copying operation is completed by two rounds of the photosensitive drum.

FIG. 2 shows the above-mentioned copying operation, wherein two copies are obtained from the same original. During the first and third revolutions, the combined developing-cleaning magnetic brush element 10 operates as the developing unit. During the second and fourth revolutions, the combined developing-cleaning magnetic brush element 10 operates as the cleaning unit. It will be clear from FIG. 2 that the photosensitive drum 12 must rotate twice to complete one copying operation. This will reduce the copying speed.

In accordance with the present invention, the copying speed is enhanced as compared with the system shown in FIGS. 1 and 2 when the copy sheet is smaller than a half size of the photosensitive drum surface.

Figure 3:
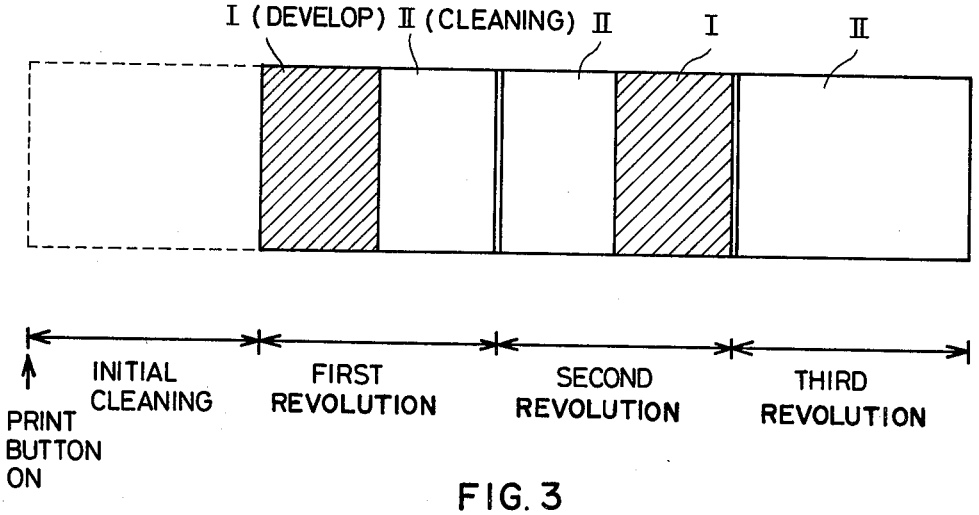
FIG. 3 is a spread view of a photosensitive drum for explaining a copying operation in an embodiment of a copying machine of the present invention, wherein two sheets of copy are obtained by three rounds of the photosensitive drum.

Now assume that the photosensitive drum 12 has the surface capable of producing a copy on a copy paper of size $A_3$. More specifically, the photosensitive drum 12 has the circumference of 502.4 mm (diameter is 160 mm). In the copying machine of the present invention, the copying operation is conducted in a same manner as the conventional system shown in FIGS. 1 and 2 when the copy paper is greater than $A_4$, that is when the copy paper is $B_4$ or $A_3$. When the copy paper is $A_4$ or smaller than $A_4$, the photosensitive drum 12 is divided into two regions and the copying operation is conducted in a manner as shown in FIG. 3.

More specifically, when the copying machine is placed in the multi-copy mode, during the actual first revolution of the photosensitive drum 12, the leading half region of the photosensitive drum 12 is subject to the developing operation and the trailing half region is cleaned. During the actual second revolution of the photosensitive drum 12, the cleaning operation is conducted to the leading half region and the developing operation is conducted to the trailing half region. Then, the entire surface of the photosensitive drum 12 is cleaned by the combined developing-cleaning magnetic brush element 10 while the photosensitive drum 12 rotates through its actual third revolution. These operations are repeated. That is, two sheets of copy are obtained by three revolutions of the photosensitive drum 12. Now assume that the photosensitive drum 12 rotates through 2/5 of a revolution in one second. That is, the photosensitive drum rotates 24 (twenty-four) revolutions in one minute. In this case 12 (twelve) sheets of copy are obtained in one minute in the multi-copy mode when the copy sheet is greater than $A_4$. If the copy sheet is $A_4$ or smaller than $A_4$, 16 (sixteen) sheets of copy are obtained in one minute in the multi-copy mode.

Figure 4:
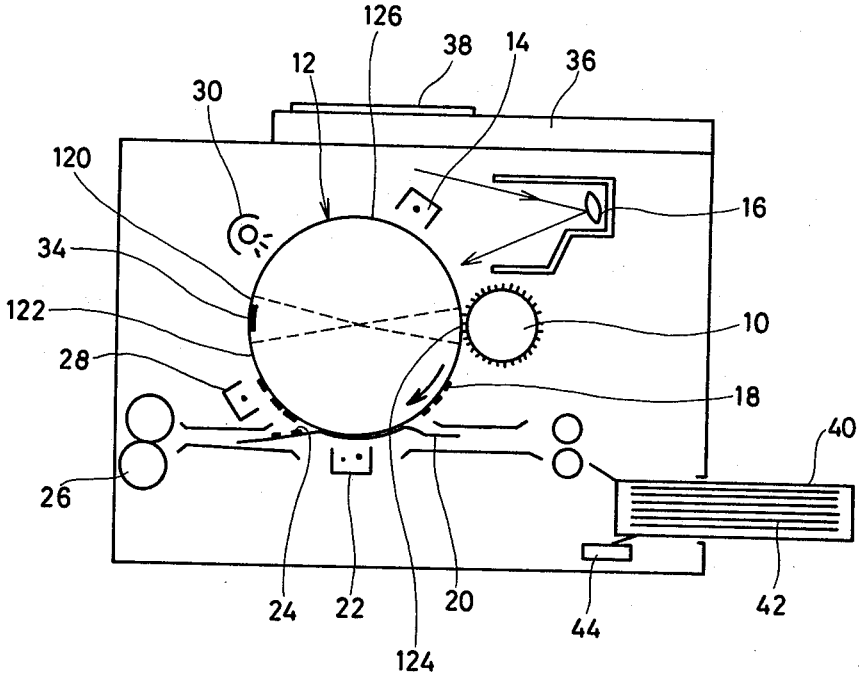
FIG. 4 is a schematic sectional view of an embodiment of a copying machine of the present invention.

FIG. 4 schematically shows an embodiment of a copying machine of the present invention. Like elements corresponding to those of FIG. 1 are indicated by like numerals.

The photosensitive drum 12 comprises a drum and a photosensitive sheet wound around the drum, the photosensitive sheet being secured to the drum by a securing grip 34. An original carrier 36 is slidably disposed on the body of the copying machine. When an original 38 of $A_4$ size is disposed on the original carrier 36, a copy paper cassette 40 is set at the copy sheet supplying section, the copy paper cassette 40 containing copy sheets 42 of the size $A_4$. A copy sheet size detection unit 44 is provided at the copy sheet supplying section. The copy sheet size detection unit 44 develops a first detection signal when the copy sheet stored in the copy paper cassette 40 is greater than $A_4$, namely, $A_3$ or $B_4$. The copy sheet size detection unit 44 develops a second detection signal when the copy sheet stored in the copy paper cassette 40 is $A_4$ or smaller than $A_4$.

A timing plate 46 (FIG. 5) is secured to the shaft of the photosensitive drum 12 so that the timing plate 46 rotates in unison with the rotation of the photosensitive drum 12. The timing plate 46 includes a first series of timing apertures $A_0$ through $A_5$ for controlling the copying operation to be conducted onto a large size copy paper such as the size of $A_3$ and $B_4$. The timing plate 46 further includes a second series of timing apertures $B_1$ through $B_5$ for controlling the copying operation to be conducted onto a small size copy paper such as the size of $A_4$ and $B_5$.

Figure 6:
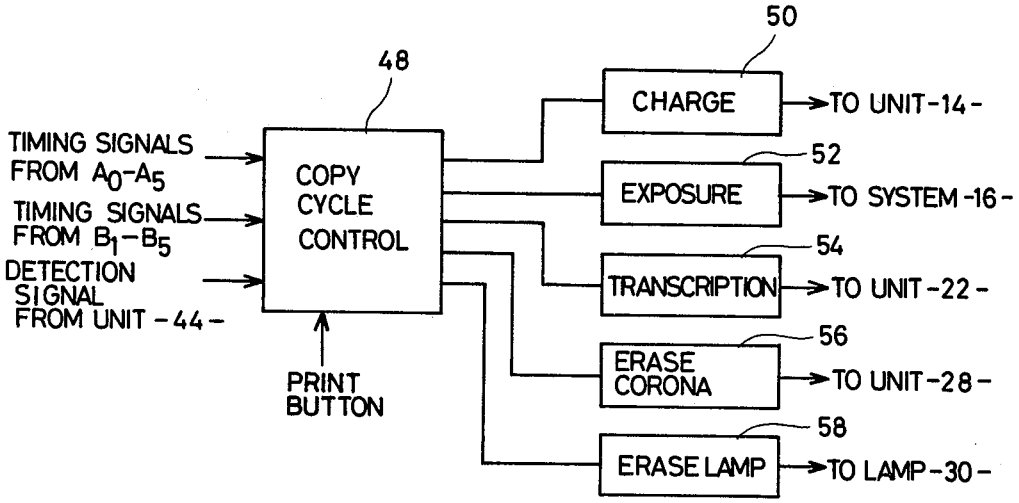
FIG. 6 is a schematic block diagram of a control system included in the copying machine of FIG. 4.

Timing signals obtained from the timing apertures $A_0$ through $A_5$ and $B_1$ through $B_5$ are applied to a copy cycle control circuit 48 included in the copying machine of the present invention. FIG. 6 schematically shows a control system of the copying machine of FIG. 4. The copy cycle control circuit 48 further receives a copy start command derived from the print button, and the first and second detection signals derived from the copy sheet size detection unit 44. The copy cycle control circuit 48 develops first through fifth control signals in response to the timing signals derived from the timing apertures $A_0$ through $A_5$ and $B_1$ through $B_5$. The first control signal is applied to a charge control unit 50 which controls the operation of the corona charging unit 14. The second control signal is applied to an exposure control unit 52 which controls the operation of the exposure system 16. The third control signal is applied to a transcription control unit 54 which controls the operation of the transcription unit 22. The fourth control signal is applied to an erase corona control unit 56 which controls the operation of the erase corona unit 28. The fifth control signal is applied to an erase lamp control unit 58 which controls the operation of the erase lamp 30.

As already discussed above, the photosensitive sheet is secured to the drum through the use of the securing grip 34. The surface of the photosensitive drum 12 is divided into four regions in the following manner. A first region 120 has a length of 42.4 mm, which covers the securing grip 34 and the clearance for the image location deviation. A second region 122 has a length of 210 mm, which covers the width of a copy sheet of $A_4$. The following third region 124 has a length of 40 mm, which is provided for ensuring a correct switching operation of various elements in the multi-copy mode of small copy sheets. A fourth region 126 has a length of 210 mm, which covers the width of a copy sheet of $A_4$.

The operational mode of the copying machine of the present invention will be described hereinbelow. The photosensitive drum 12 is held stationary in the stand-by condition so that the first region 120, which carries the securing grip 34, confronts the combined developing-cleaning magnetic brush element 10. At this moment, the timing plate 46 is held stationary so that the start timing aperture $A_0$ is located at the detection position.

Figure 5:
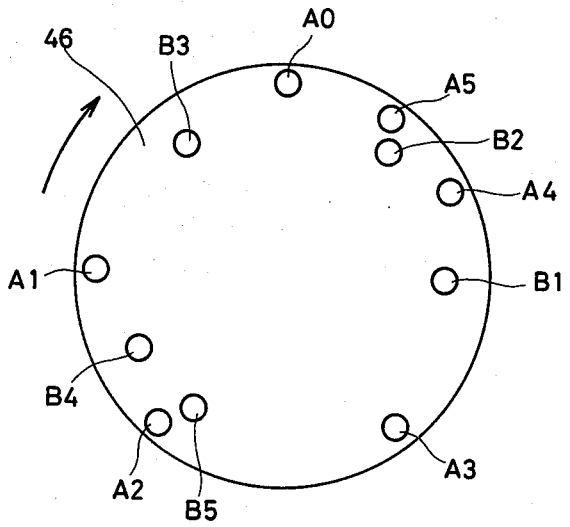
FIG. 5 is a front view of a timing plate included in the copying machine of FIG. 4.

Under these conditions when the print button is actuated, the photosensitive drum 12 and the timing plate 46 are driven to rotate in the direction shown by the arrows in FIGS. 4 and 5 in order to conduct the initial cleaning operation. During this initial cleaning operation, the corona charging unit 14, the transcription unit 22, the erase corona unit 28 and the erase lamp 30 are not energized, whereby the combined developing-cleaning magnetic brush element 10 functions to clean the surface of the photosensitive drum 12.

When the timing aperture $A_4$ reaches the detection position, the copy cycle control circuit 48 develops the first control signal to activate the charge control unit 50. The corona charging unit 14 is energized to uniformly charge the surface of the photosensitive drum 12 from the leading edge of the second region 122, whereby the copying operation is placed in the actual first revolution. When the copy sheet is greater than $A_4$ and the copy sheet size detection unit 44 develops the first detection signal, the copy cycle control circuit 48 continuously develops the first control signal till the timing aperture $A_4$ again reaches the detection position. That is, the corona charging unit 14 is energized to uniformly charge the entire surface of the photosensitive drum 12. During the actual second revolution of the photosensitive drum 12, the corona charging unit 14 is not energized. Therefore, the combined developing-cleaning magnetic brush element 10 performs the developing operation during the actual first revolution of the photosensitive drum 12, and performs the cleaning operation during the actual second revolution of the photosensitive drum 12. That is, when the copy sheet is greater than the size $A_4$, the copying machine of the present invention operates in a same manner as the conventional copying machine of which the operation mode is shown in FIG. 2.

Now assume that the copy sheet is the size $A_4$ and the copying machine is placed in the multi-copy mode. The second detection signal is developed from the copy sheet size detection unit 44. The initial cleaning operation is conducted in the same manner as discussed above. The copying machine is placed in the actual first revolution mode when the timing aperture $A_4$ is detected. The copy cycle control circuit 48 develops the first control signal till the timing aperture $B_4$ is detected. That is, the uniform charging operation is conducted at least from the leading edge of the second region 122 to the trailing edge of the second region 122. The uniform charging operation is not conducted to the third and fourth regions 124 and 126 during the actual first revolution of the photosensitive drum 12.

After detection of the timing aperture $A_4$, when the timing aperture $A_5$ is detected, the copy cycle control circuit 48 develops the second control signal, whereby the exposure system 16 is energized and the original carrier 36 is driven to travel above the body of the copying machine. An electrostatic latent image corresponding to the original 38 is formed on the second region 122 of the photosensitive drum 12. The image portion has the surface potential of a preselected level and, therefore, the combined developing-cleaning magnetic brush element 10 functions to develop the electrostatic latent image. The thus formed developed image 18 is transferred toward the transcription unit 22 by means of the rotation of the photosensitive drum 12. When the timing aperture $A_1$ is detected during the actual first revolution of the photosensitive drum 12, the copy cycle control circuit 48 develops the third control signal to the transcription control unit 54 which activates the transcription unit 22. Accordingly, the developed image 18 is transcribed onto the copy sheet 20 which is supplied from the copy paper cassette 40. The thus transcribed image 24 is fixed onto the copy sheet 20 while the copy sheet 20 travels through the fixing unit 26, thereby completing the one sheet copying operation.

It will be clear that the photosensitive drum 12 continuously rotates while the fixing operation is conducted. However, the fourth region 126 of the photosensitive drum 12 is not charged by the corona charging unit 14 because the copy cycle control circuit 48 functions to disable the corona charging unit 14 when the timing aperture $B_4$ is detected. Further, the exposure system 16 is disabled when the timing aperture $B_5$ is detected at the timing when the original exposure of $A_4$ size is completed. Therefore, the combined developing-cleaning magnetic brush element 10 functions to clean the fourth region 126 of the photosensitive drum 12 during the actual first revolution of the photosensitive drum 12. In response to the detection of the timing aperture $B_5$, the original carrier 36 is driven to travel backward for preparation of the next copying operation. Then, the transcription unit 22 is disabled when the timing aperture $B_1$ is detected. That is, the transcription unit 22 is disabled while the third and fourth regions 124 and 126 pass the transcription unit 22 in the actual first revolution of the photosensitive drum 12.

While the cleaning operation is conducted to the fourth region 126 of the photosensitive drum 12 during the last half of the first revolution of the photosensitive drum 12, the copy cycle control circuit 48 develops the fourth control signal in response to the detection of the timing aperture $A_2$ for enabling the erase corona unit 28. Further, the copy cycle control circuit 48 develops the fifth control signal when the timing aperture $A_3$ is detected for activating the erase lamp 30. The erase corona unit 28 and the erase lamp 30 function, in combination, to erase the residual image carried on the second region 122 of the photosensitive drum 12.

Then, the photosensitive drum 12 enters into the actual second revolution thereof. The detection of the timing aperture $A_4$ is negated by the copy cycle control circuit 48 and, therefore, the corona charging unit 14 is held in the nonactivated condition. Accordingly, the combined developing-cleaning magnetic brush element 10 functions to clean the surface of the second region 122 of the photosensitive drum 12 in the actual second revolution of the photosensitive drum 12. The corona charging unit 14 is activated in response to the detection of the timing aperture $B_4$ in order to uniformly charge the fourth region 126 in the actual second revolution of the photosensitive drum 12. Thereafter, when the timing aperture $B_5$ is detected, the original carrier 36 is driven to travel forward, and the copy cycle control circuit 48 develops the second control signal for activating the exposure system 16. Thus, the electrostatic latent image is formed on the fourth region 126 of the photosensitive drum 12 during the actual second revolution of the photosensitive drum 12. At this moment, the combined developing-cleaning magnetic brush element 10 functions to develop the electrostatic latent image formed on the fourth region 126 of the photosensitive drum 12. The thus formed developed image 18 is transcribed onto the copy sheet 20 by means of the transcription unit 22 which is activated by the copy cycle control circuit 48 in response to the detection of the timing aperture $B_1$.

Then, the photosensitive drum 12 enters into the actual third revolution thereof. The erase corona unit 28 is activated in response to the detection of the timing aperture $B_2$, and the erase lamp 30 is activated in response to the detection of the timing aperture $B_3$, whereby the residual image carried on the fourth region 126 of the photosensitive drum 12 is erased. The activation of the exposure system 16 is terminated in response to the detection of the timing aperture $A_5$, and the original carrier 36 is driven to travel backward for prepearing the next copying operation. Of course, at the end of the actual second revolution of the photosensitive drum 12, when the timing aperture $A_4$ is detected, the corona charging unit 14 is deenergized. Accordingly, during the actual third revolution of the photosensitive drum 12, the combined developing-cleaning magnetic brush element 10 functions to clean the entire regions 120 through 126 of the photosensitive drum 12. The above-mentioned operations of the actual first, second and third revolution are repeated. That is, two sheets of copy are obtained by three revolutions of the photosensitive drum 12 when the copying machine is placed in the multi-copy mode and the copy sheet is smaller than or equal to the size $A_4$.

When the copying operation of a desired sheet number is completed, the photosensitive drum 12 is held at the stand-by condition wherein the first region 120 confronts the combined developing-cleaning magnetic brush element 10, in response to the detection of the timing aperture $A_0$. When the copying machine is placed in the single-copy mode, the copying operation is conducted in the same manner as the conventional system shown in FIG. 2 even when the copy sheet is $A_4$ or $B_5$. Further, in the case where the copying operation is conducted to copies numbering $2n+1$ ($N=1, 2, 3, \ldots$) in the multicopy mode, the last sheet copying operation is conducted in the same manner as the conventional system shown in FIG. 2.

In accordance with the present invention, two sheets of copy are obtained for every three revolution of the photosensitive drum if the copy sheet is smaller than a half of the surface size of the photosensitive drum and the copying machine is placed in the multi-copy mode. Therefore, the copying speed is enhanced as compared with the conventional system shown in FIG. 2. If the photosensitive drum has a size capable of copying onto a copy sheet of the size $A_2$, the present copying process is applicable to the copying operation for a copy sheet of size $A_3$. The present copying method is effective to ensure a uniform characteristic of the photosensitive drum surface because the second region 122 and the fourth region 126 are alternately used in the multicopy mode when the copy sheet is smaller than half of the size of the photosensitive drum surface.

However, note that the third region 124 does not receive the charging operation in the above-mentioned multi-copy operation. Accordingly, there is the possibility that the second and fourth regions 122 and 126 are damaged to a greater degree than the third region 124. This will prevent a clean copying operation when the copy sheet is greater than $A_4$.

Accordingly, in a preferred form of the present invention, the copy cycle control circuit 48 functions to continuously enable the transcription unit 22, the erase corona unit 28 and the erase lamp 30 in the multi-copy mode, thereby applying the charging operation even onto the third region 124.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electrophotographic copying machine comprising in combination:

a photosensitive member rotatably mounted having a predetermined surface size;

drive means for rotating said photosensitive member at a preselected velocity;

a combined developing-cleaning magnetic brush element for selectively conducting a developing operation and a cleaning operation;

a copy sheet size detection unit for detecting the size of a copy sheet and developing a first detection signal when said copy sheet is greater than one half of said predetermined surface size of said photosensitive member, and developing a second detection signal when said copy sheet is equal to or less than one half of said predetermined surface size of said photosensitive member; and control means for activating said combined developing-cleaning magnetic brush element in a manner such that when said second detection signal is developed from said copy sheet size detection unit, during a first revolution of said photosensitive member, said combined developing-cleaning magnetic brush element conducts said developing operation onto a first half section of said photosensitive member and conducts said cleaning operation onto a second half section of said photosensitive member and during a second revolution of said photosensitive member said combined developing-cleaning magnetic brush element conducts said cleaning operation onto said first half section of said photosensitive member and conducts said developing operation onto said second half section of said photosensitive member.

2. The electrophotographic copying machine of claim 1, wherein:

said photosensitive member comprises a photosensitive sheet wound around a drum, secured to said drum through the use of a securing grip; and said drive means is connected to said drum for rotating said drum at a preselected velocity.

3. The electrophotographic copying machine of claim 2, wherein said photosensitive member is divided into three regions, comprising:

a first region and a second region each having a size slightly smaller than one half of said predetermined surface size of said photosensitive member; and a third region disposed between said first and second regions, said third region being located at the opposing side to said securing grip.

4. The electrophotographic copying machine of claim 3, wherein said copy sheet size detection unit develops said first detection signal when said copy sheet is greater than the size of said first region, and develops said second detection signal when said copy sheet has a size equal to or smaller than the size of said first region.

5. The electrophotographic copying machine of claim 1, wherein said control means is connected to a corona charging unit for selectively activating said corona charging unit, such that said combined developing-cleaning magnetic brush element performs said developing operation when said corona charging unit is activated, and performs said cleaning operation when said corona charging unit is not activated.

6. An electrophotographic copying machine comprising in combination:

a photosensitive drum;

drive means for rotating said photosensitive drum at a preselected velocity;

a corona charging unit for uniformly charging said photosensitive drum;

an exposure unit for forming an electrostatic latent image on said photosensitive drum;

a combined developing-cleaning magnetic brush element for selectively conducting a developing operation and a cleaning operation;

a copy sheet supply means for supplying copy sheets;

a transcription unit for transcribing a developed image onto said copy sheet supplied from said copy sheet supply means;

erase means for erasing a residual image carried on said photosensitive drum;

a copy sheet size detection unit for detecting the size of said copy sheet and developing a first detection signal when said copy sheet is greater than one half of the surface size of said photosensitive drum, and developing a second detection signal when said copy sheet is equal to or less than one half of said surface size of said photosensitive drum; and an operation control means responsive to said first and second detection signals developed from said copy sheet size detection unit for activating said corona charging unit and said exposure unit during respective revolutions of said photosensitive drum, and for activating said combined developing-cleaning magnetic brush element in a manner such that when said second detection signal is developed from said copy sheet size detection unit, during a first revolution of said photosensitive member, said combined developing-cleaning magnetic brush element conducts said developing operation onto a first half section of said photosensitive member and conducts said cleaning operation onto a second half section of said photosensitive member and during a second revolution of said photosensitive member said combined developing-cleaning magnetic brush element conducts said cleaning operation onto said first half section of said photosensitive member and conducts said developing operation onto said second half section of said photosensitive member.

7. An electrophotographic copying machine of claim 5, further including an exposure unit for forming an electrostatic latent image on said photosensitive drum, a copy sheet supply means for supplying copy sheets, and a transcription unit for transcribing a developed image to said copy sheets.

* * * * *